US010236147B2

(12) United States Patent
Takeda

(10) Patent No.: US 10,236,147 B2
(45) Date of Patent: Mar. 19, 2019

(54) THERMAL PROTECTOR

(71) Applicant: Uchiya Thermostat Co., Ltd., Saitama-Ken (JP)

(72) Inventor: Hideaki Takeda, Saitama (JP)

(73) Assignee: Uchiya Thermostat Co., Ltd., Saitama (JP)

( * ) Notice: Subject to any disclaimer, the term of this patent is extended or adjusted under 35 U.S.C. 154(b) by 0 days.

(21) Appl. No.: 15/310,117

(22) PCT Filed: Dec. 10, 2015

(86) PCT No.: PCT/JP2015/084713
§ 371 (c)(1),
(2) Date: Nov. 10, 2016

(87) PCT Pub. No.: WO2016/174794
PCT Pub. Date: Nov. 3, 2016

(65) Prior Publication Data

US 2018/0053613 A1 Feb. 22, 2018

(30) Foreign Application Priority Data

Apr. 28, 2015 (JP) ..... 2015-091487

(51) Int. Cl.
*H01H 37/54* (2006.01)
*H01H 37/04* (2006.01)
*H01H 71/16* (2006.01)

(52) U.S. Cl.
CPC ..... *H01H 37/5418* (2013.01); *H01H 37/04* (2013.01); *H01H 71/16* (2013.01)

(58) Field of Classification Search
CPC ..... H01H 37/04; H01H 37/5418; H01H 71/16
(Continued)

(56) References Cited

U.S. PATENT DOCUMENTS 6,503,647 B1 1/2003 Sugiyama et al.
2001/0050609 A1 12/2001 Takeda
2004/0075526 A1* 4/2004 Takeda ..... H01H 37/5418 337/36

FOREIGN PATENT DOCUMENTS

JP 03141524 A 6/1991
JP 2636615 B2 7/1993
(Continued)

OTHER PUBLICATIONS

"International Application No. PCT/JP2015/084713, International Search Report dated Mar. 15, 2016", w/ English Translation, (Mar. 15, 2016), 5 pgs.

(Continued)

*Primary Examiner* — Thienvu Tran
*Assistant Examiner* — Kevin J Comber
(74) *Attorney, Agent, or Firm* — Schwegman Lundberg & Woessner, P.A.

(57) ABSTRACT

A thermal protector may be used to switch an electric circuit of an electrical product. The thermal protector may include first and second terminals and a fixed contact connected to the first terminal. The thermal protector may include a movable contact facing the fixed contact. The thermal protector may include a bimetal and an elastically-deformable movable plate that engages the bimetal and on which the movable contact is fixed. The movable plate may be connected to the second terminal. The terminals may be held by respective insulating blocks. The bimetal or the moveable plate may be arranged to be within an area between the respective insulating blocks.

8 Claims, 8 Drawing Sheets

(58) Field of Classification Search
USPC ..... 361/105
See application file for complete search history.

(56) References Cited

FOREIGN PATENT DOCUMENTS

| | | | |
|---|---|---|---|
| JP | 1153980 | A | 2/1999 |
| JP | 2001057205 | A | 2/2001 |
| JP | 2001118479 | A | 4/2001 |
| JP | 2001307607 | A | 11/2001 |

OTHER PUBLICATIONS

"International Application No. PCT/JP2015/084713, Written Opinion dated Mar. 15, 2016", (Mar. 15, 2016), 3 pgs.

* cited by examiner

THERMAL PROTECTOR

PRIORITY APPLICATIONS

This application is a U.S. National Stage Filing under 35 U.S.C. 371 from International Application No. PCT/JP2015/084713, filed on 10 Dec. 2015, and published as WO 2016/174794 on 3 Nov. 2016, which claims the benefit of priority to Japanese Application No. 2015-091487, filed on 28 Apr. 2015; which applications and publication are incorporated herein by reference in their entirety.

TECHNICAL FIELD

The present invention relates to a thermal protector that switches an electric circuit of an electrical product.

RELATED ART

Conventionally, a thermal protector is known that is incorporated into a hot-air generating device such as a hair dryer, a fan heater, or a popcorn machine and senses a temperature of hot air so as to open and close contacts for turning off the device. Normally, such a thermal protector includes a bimetal as a thermally-actuated element in order to prevent overheating of a hot-air generating device.

As such a thermal protector that includes a bimetal, a thermal protector has been proposed that has a trapezoidally-shaped section obtained by partially cutting its quadrangular cross-sectional shape in order to incorporate it into a valley-shaped space situated between adjacent batteries, the thermal protector being used for protecting an assembled battery (see, for example, Patent Document 1).

Further, a push-on switch in which an inside bottom is arranged inclined in a substantially square section has been proposed (see, for example, Patent Document 2).

CITATION LIST

Patent Document

Patent Document 1: Japanese Patent No. 2636615

Patent Document 2: Japanese Laid-open Patent Publication No. 11-53980

SUMMARY OF INVENTION

Technical Problem

In an electric product such as a hair dryer, for example, insulating plates are combined in a cross shape, a coiled heating wire is wound around them, and air is sent from behind using a motor fan, so as to configure a hot air generator.

When an electric product including a hot air generator configured as described above is made smaller, the dimensional restraint inside the electric product will increase, and a space into which a thermal protector can be incorporated will be limited if a certain insulation distance is maintained, which does not allow a conventional thermal protector to be provided in an electric product.

A member that will suffer the most significant limitation when a thermal protector is made smaller is bimetal that is a thermally-actuated element. For example, if the space to which a thermal protector can be attached is limited to a space having a section of a few millimeters square in consideration of the insulation distance, the bimetal is dimensioned according to the size of the side of the section. However, a larger failure occurs in a bimetal if it is made smaller in shape.

For example, a distance of a reversing movement due to a snap action is extremely reduced, and a reversing force is also extremely reduced. Generally, the thickness of a bimetal has to be adjusted according to a decrease in the area due to a reduction in size. It is not possible to perform a snap action unless the thickness is made thin, and it is also difficult to perform a temperature setting. Thus, the thickness is thinner in a smaller shape, which results in significantly reducing an output that is a reversing force. Therefore, it is necessary to ensure the maximum dimension of a bimetal in a limited space.

An object of the present invention is to save space for arranging a thermal protector.

Solution to Problem

In an aspect, a thermal protector that switches an electric circuit of an electrical product includes a first terminal and a second terminal that are each connected to an external circuit, a first insulating block that holds the first terminal, a second insulating block that holds the second terminal, a base that connects the first insulating block and the second insulating block, a fixed contact that is connected to the first terminal, a movable contact that is arranged in a position that faces the fixed contact, a bimetal whose curvature is reversed at a set temperature, and an elastically-deformable movable plate that engages the bimetal and on which the movable contact is fixed, the movable plate being connected to the second terminal so as to be fixed on the base, wherein the bimetal and the movable plate are arranged to be within an area situated between the first insulating block and the second insulating block, and are arranged to be non-parallel to every surface of the first insulating block and the second insulating block.

Advantageous Effects of Invention

According to the present invention, it is possible to save space for arranging a thermal protector.

DESCRIPTION OF EMBODIMENTS

A thermal protector according to embodiments of the present invention will now be described with reference to the drawings.

Figure 1A:
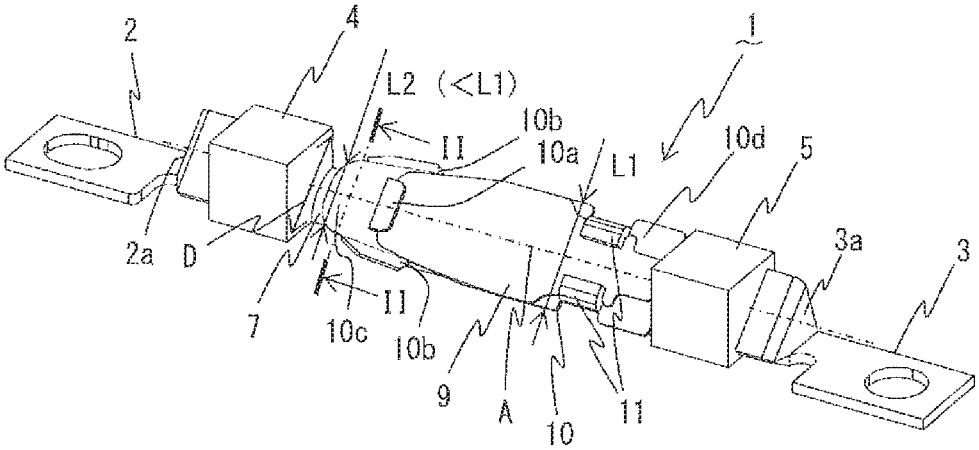
FIG. 1A is a perspective view of a thermal protector according to an embodiment of the present invention (part 1)
Figure 1B:
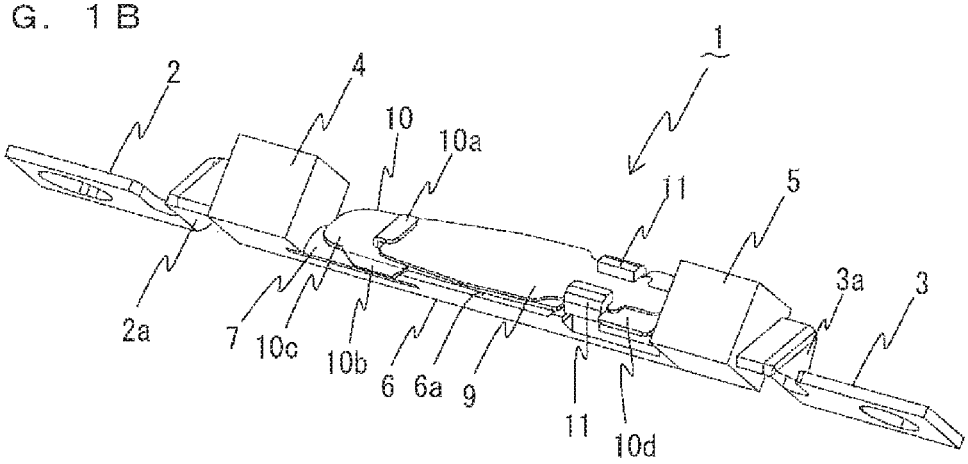
FIG. 1B is a perspective view of the thermal protector according to the embodiment (part 2)
Figure 1C:
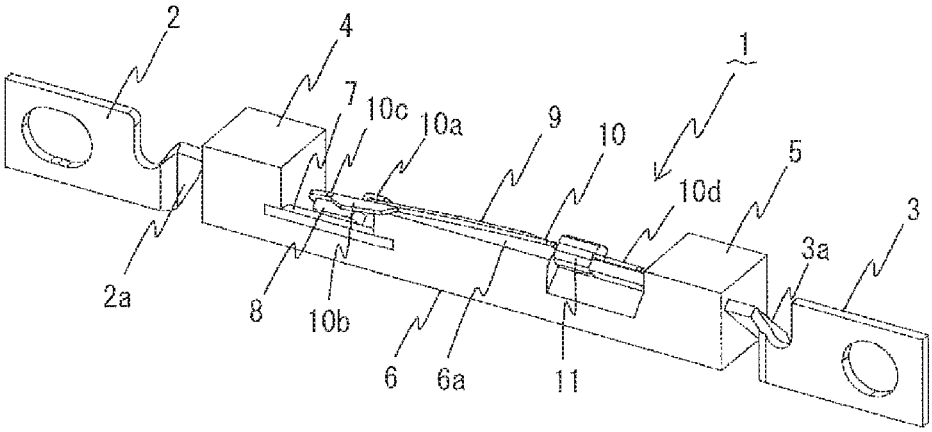
FIG. 1C is a perspective view of the thermal protector according to the embodiment (part 3)

FIGS. 1A to 1C are perspective views of a thermal protector 1 according to an embodiment of the present invention.

Figure 2A:
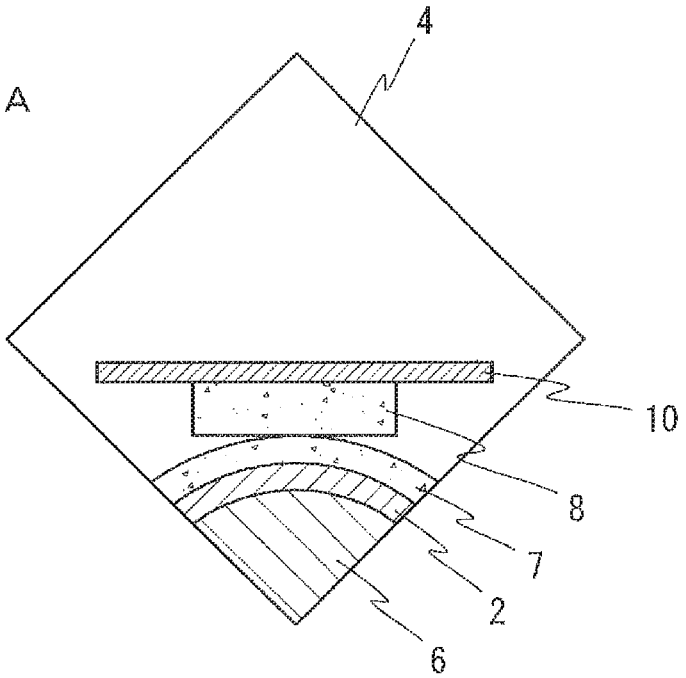
FIG. 2A is a cross-sectional view taken along line II-II of FIG. 1A (a state in which contacts are in contact)
Figure 2B:
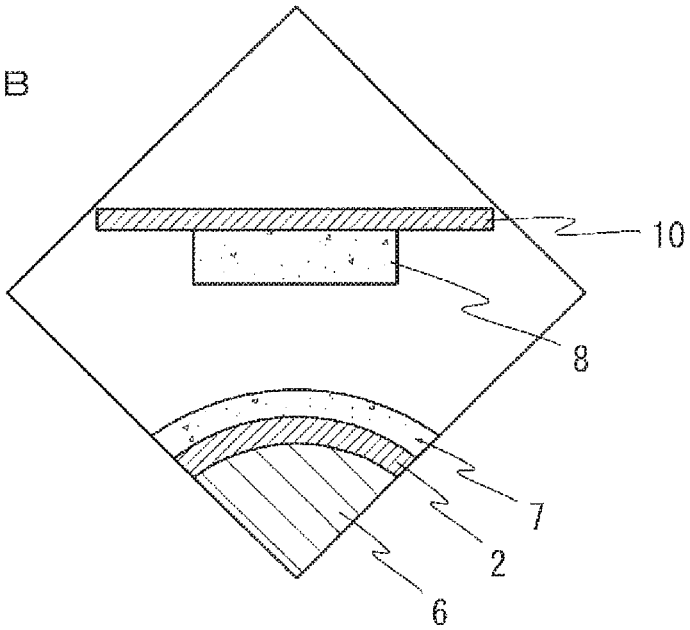
FIG. 2B is a cross-sectional view taken along line II-II of FIG. 1A in a state in which the contacts are opened.

FIG. 2A is a cross-sectional view taken along line II-II of FIG. 1A (a state in which contacts are in contact), and FIG. 2B is a cross-sectional view taken along line II-II of FIG. 1A in a state in which the contacts are opened.

FIGS. 3A to 3H are perspective views for explaining assembly of the thermal protector 1.

The thermal protector 1 illustrated in FIGS. 1A to 1C is, for example, a thermal switch that is arranged and used in a passage of hot air of an electrical product that generates hot air, and switches an electric circuit of the electrical product. Further, the thermal protector 1 is a thermal switch that exerts a greater effect when it is incorporated into, for example, a hair dryer that generates a large flow of hot air using high current.

The thermal protector 1 includes a first terminal 2, a second terminal 3, a first insulating block 4, a second insulating block 5, a base 6, a fixed contact 7, a movable contact 8, a bimetal 9, a movable plate 10, and a pair of fixtures 11.

The first terminal 2 and the second terminal 3 are each connected to an external circuit (not illustrated), for example, at an end in which a circular through hole is formed (both right and left ends of FIGS. 1A to 1C). The first terminal 2 and the second terminal 3 are respectively bent at bending portions 2*a* and 3*a* such that a portion parallel to the bimetal 9 and the movable plate 10 described later and each of the portions to be connected to the external circuit described above are tilted at different angles from each other. The first terminal 2 and the second terminal 3 are respectively configured to be narrow around the bending portions 2*a* and 3*a*, wherein these portions are deformable so that an external force will not affect the inside of the thermal protector 1 (such as an area situated between the first insulating block 4 and the second insulating block 5).

The bottom surface of a portion of each of the first terminal 2 and the second terminal 3 is situated in plane with the bottom surfaces of the first insulating block 4 and the second insulating block 5, or the bottom surface of the base 6, or all of the bottom surfaces (all of the bottom surfaces in the examples of FIGS. 1A to 1C), wherein the portions are each to be connected to an external circuit as described above.

Figure 4:
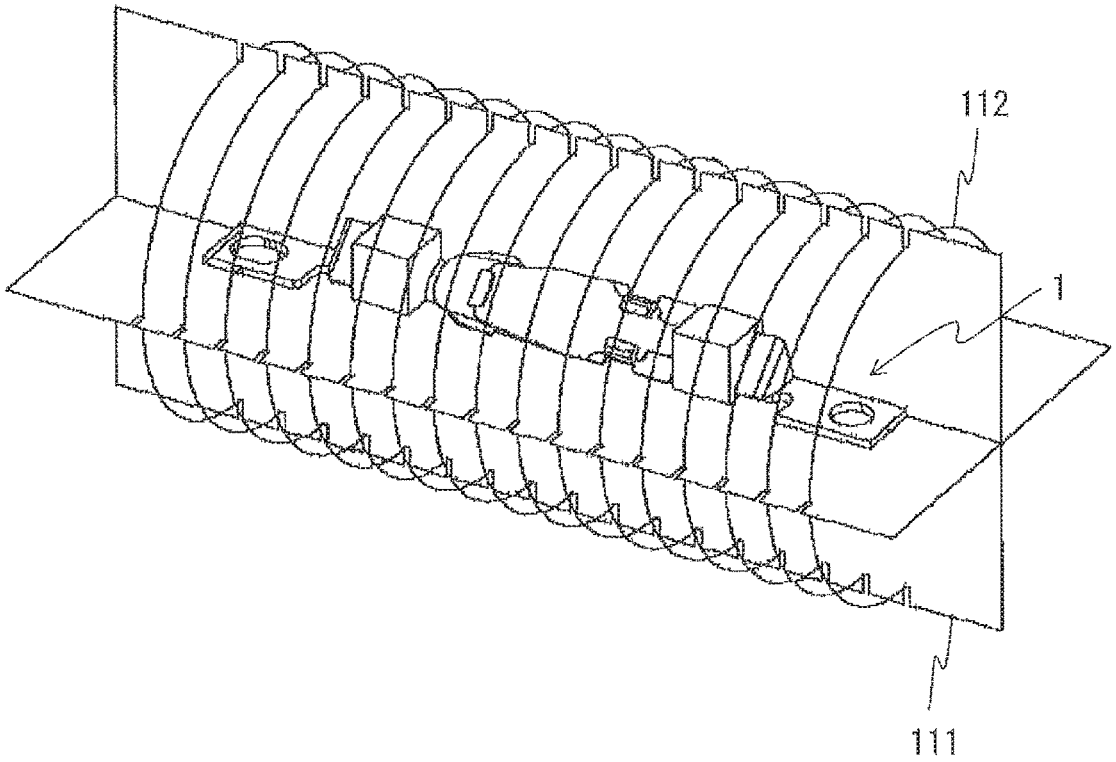
FIG. 4 is a perspective view that illustrates an example in which the thermal protector according to the embodiment is arranged in a cross-shaped insulating plate.
Figure 5:
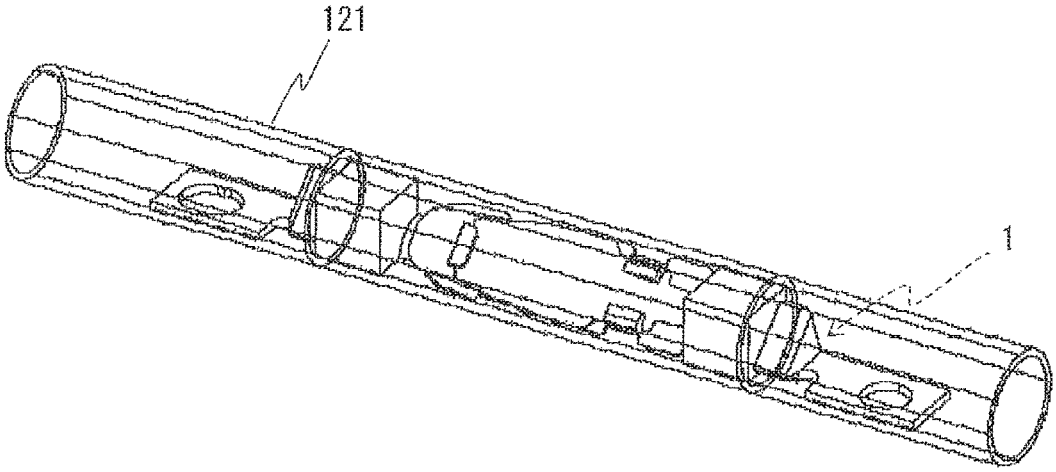
FIG. 5 is a perspective view that illustrates an example in which the thermal protector according to the embodiment is arranged in a cylindrical case.

In this case, the bottom surface of each component of the thermal protector 1 corresponds to an attachment surface when the thermal protector 1 is attached to an attachment target such as a cross-shaped insulating plate 111 illustrated in FIG. 4, or corresponds to a surface on the side of the attachment surface, wherein the attachment surface is not limited to facing upward in a vertical direction, but may face in another direction such as a horizontal direction. However, in the present embodiment, the side of the bottom surface described above is referred to as "downward", and the side of the top surface is referred to as "upward". A nichrome wire 112 that is an example of a heating wire is wound spirally around the cross-shaped insulating plate 111 of FIG. 4. Further, the thermal protector 1 may be attached to another place such as inside a cylindrical case 121, as illustrated in FIG. 5.

As illustrated in FIG. 1A, the first insulating block 4 holds the first terminal 2. The second insulating block 5 holds the second terminal 3. The first insulating block 4 and the second insulating block 5 each have a shape of a quadrangular prism having a central axis A, the central axes A of the quadrangular prisms for the first insulating block 4 and the second insulating block 5 being situated in one line. In the examples of FIGS. 1A to 1C, the first insulating block 4 and the second insulating block 5 each have a cubic shape. Further, the central axis A is surrounded by four sides of the first insulating block 4 and by four sides of the second insulating block 5, wherein each of the four sides of the first insulating block 4 and a corresponding one of the four sides of the second insulating block 5 are situated in plane with each other.

The first insulating block 4 and the second insulating block 5 play a role in holding the first terminal 2 and the second terminal 3, respectively, and play a role in limiting the effect of an external force on the inside of the thermal protector 1 through the first terminal 2 and the second terminal 3, respectively.

For example only, the first insulating block 4 and the second insulating block 5 are each 4.0 mm on a side, and spacing of 17.0 mm is provided between the first insulating block 4 and the second insulating block 5.

The base 6 connects the first insulating block 4 and the second insulating block 5. The base 6 is made of, for example, insulating synthetic resin. For example only, in the present embodiment, the base 6 is integral with the lower half (4) of the first insulating block 4 and the lower half (5) of the second insulating block 5 illustrated in FIG. 3B. In order to increase the strength of the thermal protector 1, they are formed using a resin molding technique which permits an easy increase in the strength when the thermal protector 1 is small. Examples of resin materials are a thermosetting resin such as phenolic resin, and a thermosetting resin such as a heat resistant LCP, PPS, and PBT, and in particular, it is preferably a glass-fiber reinforced resin. The base 6 is provided so as to be situated between the first insulating block 4 and the second insulating block 5, but the first insulating block 4 and the second insulating block 5 may be fixed on the base 6.

As illustrated in FIGS. 2A and 2B, the base 6 has a fan shape. In FIGS. 2A and 2B, the left lower surface is the bottom surface of the base 6.

Figures 3A, 3B, 3C, 3D, 3E, 3F, 3G, 3H:
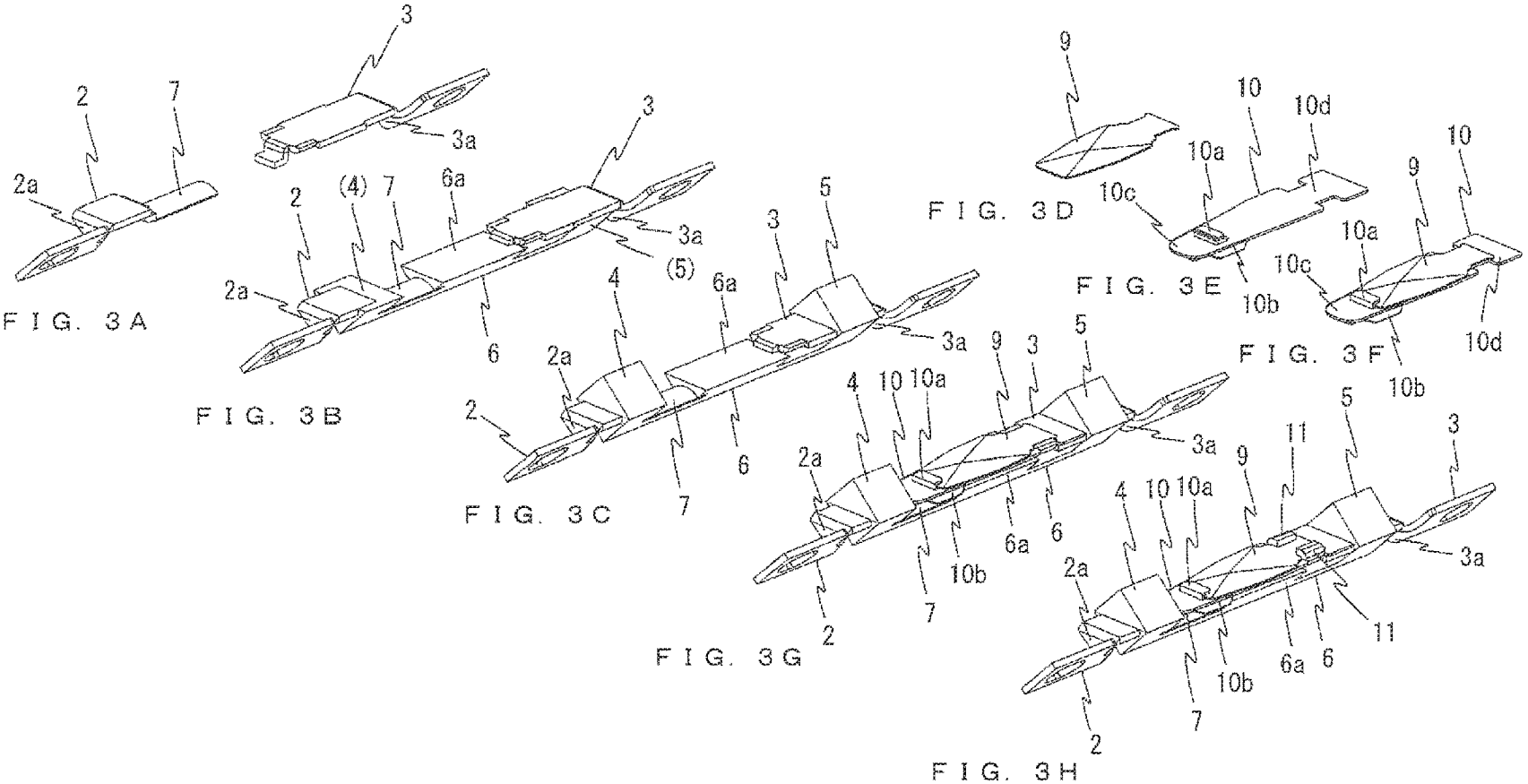
FIG. 3A is a perspective view for explaining assembly of the thermal protector (part 1)
FIG. 3B is a perspective view for explaining the assembly of the thermal protector (part 2)
FIG. 3C is a perspective view for explaining the assembly of the thermal protector (part 3)
FIG. 3D is a perspective view for explaining the assembly of the thermal protector (part 4)
FIG. 3E is a perspective view for explaining the assembly of the thermal protector (part 5)
FIG. 3F is a perspective view for explaining the assembly of the thermal protector (part 6)
FIG. 3G is a perspective view for explaining the assembly of the thermal protector (part 7)
FIG. 3H is a perspective view for explaining the assembly of the thermal protector (part 8)

As illustrated in FIGS. 3A to 3C, a base part 6*a* that is contactable by the bottom surface of the movable plate 10 described later is formed in the longitudinal middle of the base 6. As illustrated in FIG. 1C, the base part 6*a* has a height decreasing toward the movable contact 8 in the longitudinal direction of the base 6.

The fixed contact 7 is connected to the first terminal 2. For example, as illustrated in FIG. 3A, the fixed contact 7 is fixed on the top surface of one end of the first terminal 2, the end being situated opposite to the other end that is to be connected to an external circuit. The fixed contact 7 (and a contact surface of the fixed contact 7 that is to be in contact with the movable contact 8) and the first terminal 2 in its portion on which the fixed contact 7 is fixed each have an arched shape in a section perpendicular to the above-described central axis A (that is, the cross section taken along line II-II in FIGS. 2A and 2B), wherein the amount of protrusion in a direction of the movable contact 8 is greater in the middle than in both ends in the arched shape.

As illustrated in FIG. 1C and FIGS. 2A and 2B, the movable contact 8 is fixed on the bottom surface of a free end 10*c* of the movable plate 10 described later, in a position that faces the fixed contact 7.

The bimetal 9 is a thermally-actuated element whose curvature is reversed at a set temperature. This will be described in detail later, but normally, the entirety of the bimetal 9 is convex upward, wherein both sides situated across the convexity from each other are oriented downward.

As illustrated in FIGS. 1A to 1C and 3E, the movable plate 10 has an engagement claw 10*a* and paired bent plate portions 10*b*, and is formed to be elastically deformable. The movable plate 10 is elastically deformed according to the shape of the bimetal 9, due to the reversal of the curvature of the bimetal 9. The movable plate 10 is preferably a good conductor of electricity, and for example, a common copper alley for a spring is used.

As illustrated in FIGS. 3D to 3F, an end of the bimetal 9 is inserted under the engagement claw 10*a*. Accordingly, the bimetal 9 is engaged with the movable plate 10. The engagement claw 10*a* is formed by, for example, performing cutting, raising, and bending on the movable plate 10.

As illustrated in FIGS. 1A to 1C, both widthwise ends of the movable plate 10 that are situated across the engagement claw 10*a* from each other are bent downward, so as to form the paired bent plate portions 10*b*. The bent plate portion 10*b* is configured to have a height that is less than about a half of the width of the movable plate 10. The paired bent plate portions 10*b* face each other to sandwich a portion of the movable contact 8 between them, so as to restrict the ventilation at the contact of the movable contact 8 and the fixed contact 7. This prevents a breaking arc generated at the contact from being lengthened by wind, which results in being also able to prevent the breaking arc from jumping from the contact to a conductive portion other than the contact and from occurring a failure.

As illustrated in FIGS. 3C and 3G, the movable plate 10 is fixed at one end along with the bimetal 9 using the pair of fixtures 11, such that the second terminal 3 is situated between the movable plate 10 and the base 6. Accordingly, the movable plate 10 is connected to the first terminal 2 so as to be fixed on the base 6.

As illustrated in FIGS. 1A to 1C, the movable plate 10 is fixed on the base 6 in a cantilevered state at a fixed end 10*d* that is the one end to be fixed using the pair of fixtures 11. Further, as illustrated in FIG. 1A, the movable plate 10 has a width decreasing toward the free end 10*c* on the side of the free end 10*c*, that is, on the side of the other end (L2<L1). The bimetal 9 is similar in that it also has such a decreasing width.

As described above, the bimetal 9 energizes the free end 10*c* of the movable plate 10 so as to hold the free end 10*c* downward because normally, the entirety of the bimetal 9 is convex upward. Thus, the movable plate 10 pushes the movable contact 8 using its elastic force, such that the movable contact 8 is in contact with the fixed contact 7 with appropriate contact force. As described above, as illustrated in FIG. 2A, the state in which the movable contact 8 is in contact with the fixed contact 7 is a normal mode because the thermal protector 1 is a normally closed switch.

In other words, this is a state before it operates as a switch. This state creates a condition in which current from an external circuit can be conducted between the first terminal 2 and the second terminal 3 through the movable contact 8 and the fixed contact 7.

On the other hand, the state in which the movable contact 8 is separated from the fixed contact 7 as illustrated in FIG. 2B, that is, a state when the contacts are opened, occurs when the bimetal 9 is thermally actuated due to the ambient temperature being changed to a predetermined high temperature, and the curvature of the bimetal 9 is reversed to be concave upward from the normal state. This is a state in which the curvature of the bimetal 9 is reversed so that the entirety of the bimetal 9 is concave outward, and the free end 10*c* of the movable plate 10 is then raised above, so as to open the contacts, that is, a state after it operates as a switch.

The bimetal 9 and the movable plate 10 are arranged to be within an area situated between the first insulating block 4 and the second insulating block 5. Further, the bimetal 9 and the movable plate 10 are arranged to be non-parallel to each of the surfaces (all of the surfaces) of the first insulating block 4 and the second insulating block 5 (that is, arranged to slope with respect to, or to intersect with, all of the surfaces of the first insulating block 4 and the second insulating block 5), and they are preferably arranged parallel to a direction D of a diagonal of each of the first insulating block 4 and the second insulating block 5 that is perpendicular to the central axis A, as illustrated in FIG. 1A. Both when the contacts are in contact, as illustrated in FIG. 2A, and when the contacts are opened, as illustrated in FIG. 2B, the bimetal 9 and the movable plate 10 are arranged to be within the area situated between the first insulating block 4 and the second insulating block 5.

In the embodiment described above, the bimetal 9 and the movable plate 10 are arranged to be within the area situated between the first insulating block 4 and the second insulating block 5, and are arranged to be non-parallel to each of the surfaces of the first insulating block 4 and the second insulating block 5. Thus, it is possible to make the bimetal 9 and the movable plate 10 larger within the area situated between the first insulating block 4 and the second insulating block 5. This results in being able to arrange, in a smaller space, the thermal protector 1 that includes the bimetal 9 and the movable plate 10 that each have a size sufficient to secure a desired output that is a reversing force. Therefore, according to the present embodiment, it is possible to save space for arranging the thermal protector 1.

In the present embodiment, the first insulating block 4 and the second insulating block 5 each have a shape of a quadrangular prism having a central axis A, the central axes A of the quadrangular prisms for the first insulating block 4 and the second insulating block 5 being situated in one line, and the central axis A is surrounded by four sides of the first insulating block 4 and by four sides of the second insulating block 5, wherein each of the four sides of the first insulating block 4 and a corresponding one of the four sides of the second insulating block 5 are situated in plane with each other. This makes it possible to easily make the bimetal 9 and the movable plate 10 larger within the area situated between the first insulating block 4 and the second insulating block 5 that have an identical quadrangular prism shape. Therefore, it is possible to further save space for arranging the thermal protector 1.

In the present embodiment, the bimetal 9 and the movable plate 10 are arranged parallel to the direction D of the diagonal of each of the first insulating block 4 and the second insulating block 5 that is perpendicular to the central axis A. Thus, it is possible to make the bimetal 9 and the movable plate 10 largest within the area situated between the first insulating block 4 and the second insulating block 5. Therefore, it is possible to further save space for arranging the thermal protector 1.

In the present embodiment, the bottom surface of each of the first terminal 2 and the second terminal 3 is situated in plane with the bottom surfaces of the first insulating block 4 and the second insulating block 5, or the bottom surface of the base 6, or all of the bottom surfaces. Thus, it is possible to contact one of the first insulating block 4, the second insulating block 5, and the base 6 with an attachment target to which the thermal protector 1 is to be attached. Therefore, it is possible to further save space for arranging the thermal protector 1.

In the present embodiment, the contact surface of the fixed contact 7 that is to be in contact with the movable contact 8 has an arched shape in the section of each of the first insulating block 4 and the second insulating block 5 that is perpendicular to the central axis A, wherein the amount of protrusion in a direction of the movable contact 8 is greater in the middle than in both ends in the arched shape. Thus, it is possible to increase the rigidity of the fixed contact 7, which results in being able to arrange the thermal protector 1 having a predetermined rigidity in a smaller space. Therefore, it is possible to further save space for arranging the thermal protector 1.

In the present embodiment, the movable plate 10 is fixed on the base 6 in a cantilevered state at one end (the fixed end 10*d*), and the movable contact 8 is fixed on the movable plate 10 at the other end (the free end 10*c*), wherein the movable plate 10 (and the bimetal 9) has a width decreasing toward the other end at least on the side of the other end ($L2<L1$). Thus, even if the curvature of the bimetal 9 is reversed so that the entirety of the bimetal 9 is convex or concave upward, the bimetal 9 and the movable plate 10 are easily within the area situated between the first insulating block 4 and the second insulating block 5. This results in being able to easily make the bimetal 9 and the movable plate 10 larger. Therefore, it is possible to further save space for arranging the thermal protector 1.

Figure 6:
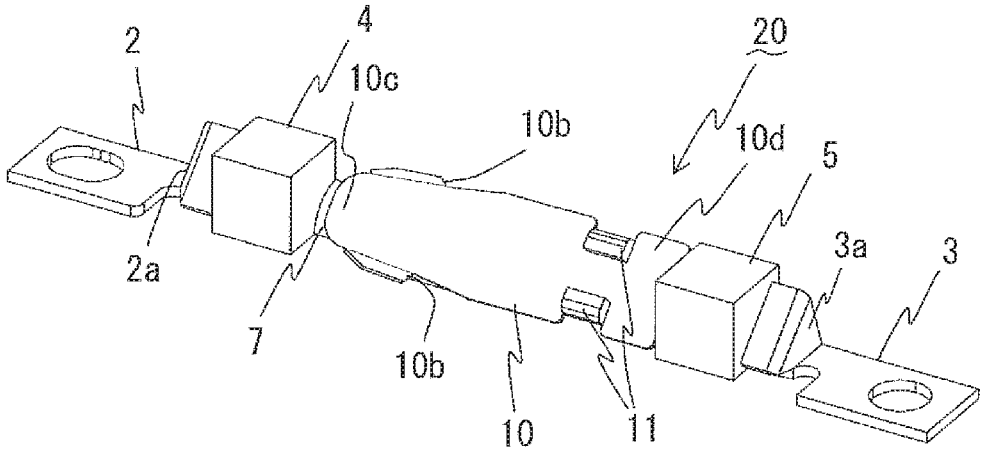
FIG. 6 is a perspective view of a first variation of the thermal protector according to of the embodiment.

In the embodiment described above, various modifications may be made without departing from the scope of embodiments. For example, in order to facilitate understanding of an operation, the state in which the bimetal 9 is arranged on the top surface of the movable plate 10 has been used to describe the embodiment, but the bimetal may be arranged on the bottom surface of the movable plate 10, as is the case in a thermal protector 20 illustrated in FIG. 6 (the bimetal is not illustrated because it is hiding under the movable plate 10). The thermal protector 20 of FIG. 6 is similar to the thermal protector 1 of FIGS. 1A to 1C except that the positions of the bimetal 9 and the movable plate 10 have been changed, the movable plate 10 being over the bimetal 9.

Figure 7:
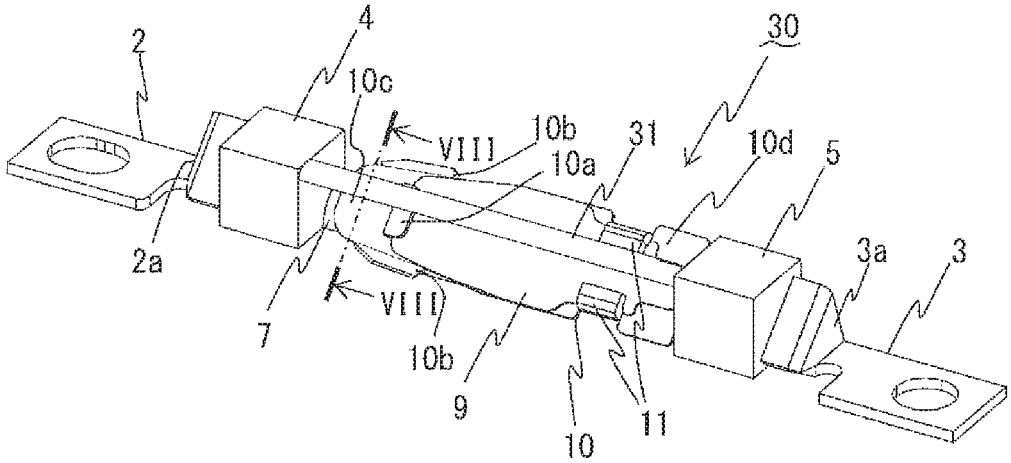
FIG. 7 is a perspective view of a second variation of the thermal protector according to the embodiment.

FIG. 7 is a perspective view of a thermal protector 30 of another embodiment of the present invention.

The thermal protector 30 of FIG. 7 is different from the thermal protector 1 of the embodiment described above only in that a beam 31 is arranged between the first insulating block 4 and the second insulating block 5. Thus, only the beam 31 is described in the present embodiment.

The beam 31 is situated across the bimetal 9 and the movable plate 10 from the base 6, and connects the first insulating block 4 and the second insulating block 5. The material of the beam 31 is, for example, metal or resin. The beam 31 may be integral with the first insulating block 4 and the second insulating block 5.

Figure 8A:
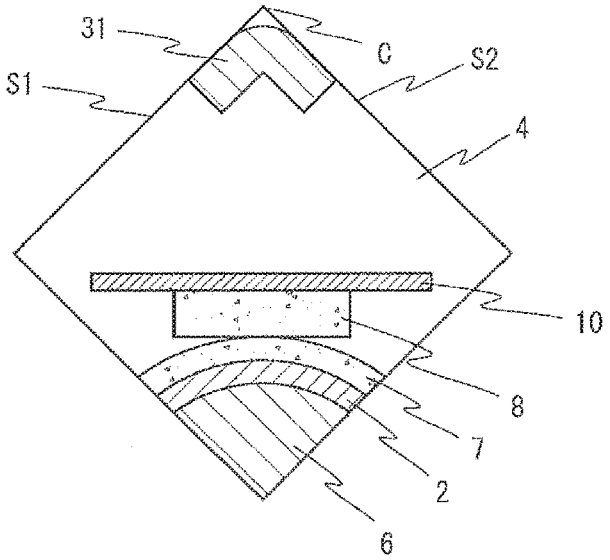
FIG. 8A is a cross-sectional view taken along line VIII-VIII of FIG. 7.

Further, as illustrated in FIG. 8A which is a cross-sectional view taken along line VIII-VIII of FIG. 7, the beam 31 is arranged along a side C of an area situated between the first insulating block 4 and the second insulating block 5, and has an L-shaped-plate shape along two surfaces S1 and S2 that are adjacent across the side C to each other.

Figure 8B:
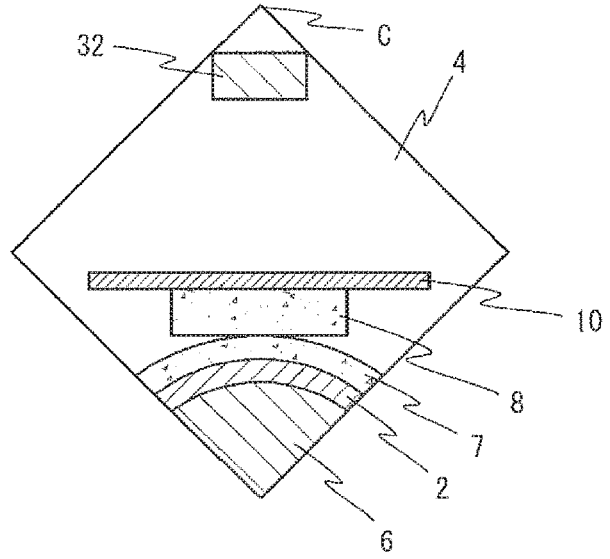
FIG. 8B is a first variation of the cross-sectional view taken along line VIII-VIII of FIG. 7.

A beam 32 in a first variation illustrated in FIG. 8B is arranged along the side C of the area situated between the first insulating block 4 and the second insulating block 5, and has a plate shape parallel to the bimetal 9 and the movable plate 10.

Figure 8C:
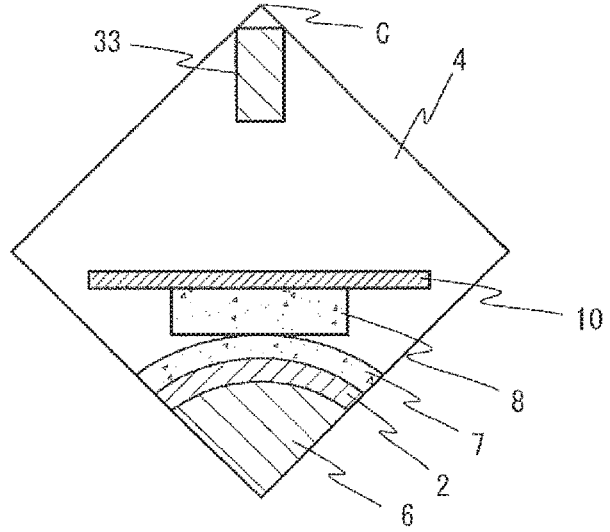
FIG. 8C is a second variation of the cross-sectional view taken along line VIII-VIII of FIG. 7.

A beam 33 in a second variation illustrated in FIG. 8C is arranged along the side C of the area situated between the first insulating block 4 and the second insulating block 5, and has a plate shape perpendicular to the bimetal 9 and the movable plate 10.

In the other embodiment described above, the beam 31, 32, 33 is situated across the bimetal 9 and the movable plate 10 from the base 6, and connects the first insulating block 4 and the second insulating block 5. Thus, it is possible to increase the rigidity of the first insulating block 4 and the second insulating block 5, which results in being able to arrange the thermal protector 30 having a predetermined rigidity in a smaller space. Therefore, it is possible to further save space for arranging the thermal protector 30.

In the present embodiment, the beam 31,32,33 is arranged along a side C of an area situated between the first insulating block 4 and the second insulating block 5, and has an L-shaped-plate shape along two surfaces S1 and S2 that are adjacent across the side C to each other (the beam 31), a plate shape parallel to the bimetal 9 and the movable plate 10 (the beam 32), or a plate shape perpendicular to the bimetal 9 and the movable plate 10 (the beam 33). Thus, it is possible to increase the rigidity of the first insulating block 4 and the second insulating block 5 by making good use of a space, in the area situated between the first insulating block 4 and the second insulating block 5, in which the bimetal 9 and the movable plate 10 are not situated. Therefore, it is possible to further save space for arranging the thermal protector 30. The configuration with the beam 31 having an L-shaped-plate shape described above makes it possible to maximize the rigidity of the first insulating block 4 and the second insulating block 5, but the configuration of the beam 32 or 33 that is parallel to, or perpendicular to, the bimetal 9 and the movable plate 10, respectively, also makes it possible to increase the rigidity of the first insulating block 4 and the second insulating block 5 sufficiently.

Although certain embodiments of the present invention have been described above, these fall within the scope of the present invention, which is defined by the appended claims and their equivalents. The following clauses describe the invention described in the claims of the originally filed application.

1. A thermal protector that switches an electric circuit of an electrical product, the thermal protector comprising:

a first terminal and a second terminal that are each connected to an external circuit;

a first insulating block that holds the first terminal;

a second insulating block that, holds the second terminal;

a base that connects the first insulating block and the second insulating block;

a fixed contact that is connected to the first terminal;

a movable contact that is arranged in a position that faces the fixed contact;

a bimetal whose curvature is reversed at a set temperature; and an elastically-deformable movable plate that engages the bimetal and on which the movable contact is fixed, the movable plate being connected to the second terminal so as to be fixed on the base, wherein the bimetal and the movable plate are arranged to be within an area situated between the first insulating block and the second insulating block, and are arranged to be non-parallel to every surface of the first insulating block and the second insulating block.

2. The thermal protector according to clause 1, wherein the first insulating block and the second insulating block each have a shape of a quadrangular prism having a central axis, the central axes of the quadrangular prisms for the first insulating block and the second insulating block being situated in one line, and the central axis is surrounded by four sides of the first insulating block and by four sides of the second insulating block, wherein each of the four sides of the first insulating block and a corresponding one of the four sides of the second insulating block are situated in plane with each other.

3. The thermal protector according to clause 2, wherein the bimetal and the movable plate are arranged parallel to a direction of a diagonal of each of the first insulating block and the second insulating block that is perpendicular to the central axis.

4. The thermal protector according to clause 2 or 3, wherein the bottom surface of each of the first terminal and the second terminal is situated in plane with the bottom surfaces of the first insulating block and the second insulating block, or the bottom surface of the base, or all of the bottom surfaces.

5. The thermal protector according to any one of clauses 2 to 4, wherein a contact surface of the fixed contact that is to be in contact with the movable contact has an arched shape in a section that is perpendicular to the central axis, wherein the amount of protrusion in a direction of the movable contact is greater in the middle than in both ends in the arched shape.

6. The thermal protector according to any one of clauses 1 to 5, wherein the movable plate is fixed on the base in a cantilevered state at one end, and the movable contact is fixed on the movable plate at another end, and the bimetal and the movable plate each have a width decreasing toward the another end at least on the side of the another end.

7. The thermal protector according to any one of clauses 1 to 6, further comprising a beam that is situated across the bimetal and the movable plate from the base, and connects the first insulating block and the second insulating block.

8. The thermal protector according to clause 7, wherein the beam is arranged along a side of an area situated between the first insulating block and the second insulating block, and has an L-shaped-plate shape along two surfaces that are adjacent across the side to each other, or a plate shape parallel to the bimetal and the movable plate, or a plate shape perpendicular to the bimetal and the movable plate.

INDUSTRIAL APPLICABILITY

The present invention is applicable in order to make a thermal protector incorporated into an electrical product that generates hot air smaller, wherein the thermal protector senses a temperature of hot air in the electrical product so as to turn off the electrical product.

REFERENCE SIGNS LIST

1,20,30 thermal protector
2 first terminal
2*a* bending portion
3 second terminal
3*a* bending portion
4 first insulating block
5 second insulating block
6 base
6*a* base part
7 fixed contact
8 movable contact
9 bimetal
10 movable plate
10*a* engagement claw
10*b* bent plate portion
10*c* free end
10*d* fixed end
11 fixture
31,32,33 beam
111 cross-shaped insulating plate
112 nichrome wire
121 cylindrical case

What is claimed is:

1. A thermal protector that switches an electric circuit of an electrical product, the thermal protector comprising:

a first terminal and a second terminal that are each connected to an external circuit;

a first insulating block that holds the first terminal;

a second insulating block that holds the second terminal;

a base that connects the first insulating block and the second insulating block;

a fixed contact that is connected to the first terminal;

a movable contact that is arranged in a position that faces the fixed contact;

a bimetal whose curvature is reversed at a set temperature; and an elastically-deformable movable plate that engages the bimetal and on which the movable contact is fixed, the movable plate being connected to the second terminal so as to be fixed on the base, wherein the bimetal and the movable plate are arranged to be within an area situated between the first insulating block and the second insulating block, and are arranged to be non-parallel to every surface of the first insulating block and the second insulating block.

2. The thermal protector according to claim 1, wherein the first insulating block and the second insulating block each have a shape of a quadrangular prism having a central axis, the central axes of the quadrangular prisms for the first insulating block and the second insulating block being situated in one line, and the central axis is surrounded by four sides of the first insulating block and by four sides of the second insulating block, wherein each of the four sides of the first insulating block and a corresponding one of the four sides of the second insulating block are situated in plane with each other.

3. The thermal protector according to claim 2, wherein the bimetal and the movable plate are arranged parallel to a direction of a diagonal of each of the first insulating block and the second insulating block that is perpendicular to the central axis.

4. The thermal protector according to claim 2, wherein a bottom surface of each of the first terminal and the second terminal is situated in plane with bottom surfaces of the first insulating block and the second insulating block, or a bottom surface of the base, or all of the bottom surfaces.

5. The thermal protector according to claim 2, wherein a contact surface of the fixed contact that is to be in contact with the movable contact has an arched shape in a section that is perpendicular to the central axis, wherein an amount of protrusion in a direction of the movable contact is greater in a middle than in both ends in the arched shape.

6. The thermal protector according to claim 1, wherein the movable plate is fixed on the base in a cantilevered state at one end, and the movable contact is fixed on the movable plate at another end, and the bimetal and the movable plate each have a width decreasing toward the another end at least on a side of the another end.

7. The thermal protector according to claim 1, further comprising a beam that is situated across the bimetal and the movable plate from the base, and connects the first insulating block and the second insulating block.

8. The thermal protector according to claim 7, wherein the beam is arranged along a side of an area situated between the first insulating block and the second insulating block, and has an L-shaped-plate shape along two surfaces that are adjacent across a side to each other, or a plate shape parallel to the bimetal and the movable plate, or a plate shape perpendicular to the bimetal and the movable plate.

* * * * *